US005413233A

United States Patent [19]

Hall

[11] Patent Number: 5,413,233

[45] Date of Patent: May 9, 1995

[54] CHILD RESISTANT BOTTLE CLOSURE

[75] Inventor: Thomas J. Hall, Cincinnati, Ohio

[73] Assignee: The Procter & Gamble Company, Cincinnati, Ohio

[21] Appl. No.: 298,008

[22] Filed: Aug. 30, 1994

[51] Int. Cl.[6] ..... B65D 50/08

[52] U.S. Cl. ..... 215/209; 215/221; 215/330

[58] Field of Search ..... 215/209, 221, 330, 217

[56] References Cited

U.S. PATENT DOCUMENTS

| | | | |
|---|---|---|---|
| 3,019,931 | 2/1962 | Thornton | 215/221 |
| 3,101,856 | 8/1963 | Whiteman, Jr. . | |
| 3,360,147 | 12/1967 | Schaefer . | |
| 3,445,022 | 5/1969 | Cilluffo . | |
| 3,881,625 | 5/1975 | Landen . | |
| 3,884,379 | 5/1975 | Landen . | |
| 3,892,326 | 7/1975 | Schneible | 215/221 |
| 3,917,097 | 11/1975 | Uhlig . | |
| 3,944,101 | 3/1976 | Landen . | |
| 3,954,200 | 5/1976 | Willis . | |
| 3,993,208 | 11/1976 | Ostrowsky . | |
| 4,036,385 | 7/1977 | Morris | 215/221 |
| 4,061,239 | 12/1977 | Tasseron | 215/221 |
| 4,103,797 | 8/1978 | Morris | 215/209 |
| 4,213,534 | 7/1980 | Montgomery . | |
| 4,345,690 | 8/1982 | Hopley . | |
| 4,427,124 | 1/1984 | Marshall et al. | 215/209 X |
| 4,807,768 | 2/1989 | Gach . | |
| 4,913,299 | 4/1990 | Petro . | |
| 4,948,002 | 8/1990 | Thornock et al. . | |
| 5,230,433 | 7/1993 | Hamilton et al. | 215/221 |

FOREIGN PATENT DOCUMENTS

| | | | |
|---|---|---|---|
| 1456216 | 12/1972 | United Kingdom | 215/209 |
| 3007071 | 4/1993 | WIPO | 215/221 |

*Primary Examiner*—Allan N. Shoap
*Assistant Examiner*—Stephen Cronin
*Attorney, Agent, or Firm*—Ronald W. Kock; Michael E. Hilton

[57] ABSTRACT

A package suitable for storing and dispensing potentially dangerous material, which is resistant to opening by children yet readily openable by adults. The package is preferably a bottle which has a body and a finish portion. The finish portion has a threaded outer end for mating with a closure. A resiliently deformable cantilevered beam is connected to the finish portion between the threaded outer end and the body of the bottle. The beam is angled outward and downward from the finish portion. The beam has a substantially vertical locking surface and a pushtab spaced along the beam. The angle of the beam is such that the pushtab may be depressed substantially radially toward the finish portion. The locking surface is located between the finish portion and the pushtab so that depression of the pushtab results in a greater beam deflection and lower deflection force at the pushtab than at the locking surface. A bottle closure has threads for rotatably securing the closure to the finish portion of the bottle. The closure also has a tooth projecting radially inward from its lower inner surface and so shaped and positioned that it will engage the locking surface of the resilient beam whenever there is an attempt to unscrew the closure. It thereby prevents removal of the closure until the pushtab is manually depressed to disengage the closure tooth from the locking surface of the cantilevered beam.

18 Claims, 3 Drawing Sheets

CHILD RESISTANT BOTTLE CLOSURE

FIELD OF THE INVENTION

The present invention relates to bottles suitable for storing and dispensing potentially dangerous materials, which are resistant to opening by children yet are readily openable by adults, and more particularly to such bottles wherein a rigid closure engages resiliently deformable portions of the bottle.

BACKGROUND OF THE INVENTION

The prior art for child resistant bottle closures generally includes three types of "safety cap." A first type has a ratchet locking system between closure and bottle in which the ratchet locking is permanent. It can be released only by fracturing an intentionally weakened portion of the system. This alternative is intended for tamper evidence, and is not useful for bottles which must maintain child resistance after multiple reclosings.

A second type of child resistant bottle closure has a resilient closure which is manually deformable to disengage a ratchet locking system between bottle and closure. This alternative is child resistant for multiple reclosings. However, squeezing a closure, which must have significant stiffness to serve its primary function as a closure, is often difficult for adults with arthritis.

A third type of child resistant bottle closure has a rigid closure and requires manual deformation of a resilient bottle feature. "Safety caps" of the third type are child resistant for multiple reclosings, and they are typically more adult friendly because the child resistant feature does not have to serve another purpose. Because the rigid closure of the third type "safety cap" cannot be inadvertently deformed, and because a child normally grips and manipulates the closure portion of a bottle in an attempt to enter it, the third type of "safety cap" generally provides the greatest child resistance. Instead of deforming the closure, the third type of "safety cap" has specific locations adjacent to the closure must be pressed to release the closure. The third type of "safety cap" is the type to which the present invention pertains.

Within the third type of child resistant closure there exists in the art a number of alternative constructions. One construction includes a collar attached to a bottle, wherein the collar has two 180° opposing, radially depressed pushtabs that are cantilevered from the bottoms of the pushtabs. When each pushtab is pressed near its center, a locking surface at the outer end of the pushtab releases a mating closure surface.

The term "radially depressed" herein means that pushtabs are pressed inward toward each other predominantly along a radius of the bottle finish. Radial depression is the optimum choice wherever two pushtabs must be depressed by one hand. They are usually depressed by a thumb and forefinger. Radial depression of opposing pushtabs ensures that both pushtabs have to be depressed simultaneously. Otherwise individually depressed pushtabs will return to their locking position when released.

Another construction has two 180° opposing pushtabs that are cantilevered from the sides of the pushtabs. Pushtabs rotate inward along a curved path which is approximately radial. Similar to the pushtabs cantilevered from their bottoms, pressing occurs at the center of the pushtab and the release of locking surfaces occurs at the outer end of the pushtabs.

A significant disadvantage of prior art pushtab designs is their poor leverage. That is, pressing at a point between the pushtab cantilever and the closure locking surface requires higher pushtab pressing forces than if pressing occurred outwardly of the closure locking surface. It has been found that in order to achieve child resistance, pushtabs must have either relatively short strokes and high depression forces or relatively long strokes and low depression forces. However, relatively high pushtab depression forces are also difficult for adults to manage. An adult user-friendly pushtab depression force should be less than about 2 lbs. It is therefore advantageous to provide pushtabs with longer strokes and lower forces. For a given pushtab depression force and stroke, it is also beneficial to have leverage between the pushtab force and the closure releasing force so that the closure releasing force can be high enough that the closure cannot be released by over twisting it against the locking mechanism.

It is believed that child resistance is also enhanced by making pushtabs unobvious for a child to press. Pushtabs which extend beyond the outermost surface of the closure are more obvious for a child to press than flush mounted or recessed pushtabs. Flush or recessed pushtabs guarded by a rigid surface adjacent to the edges of the pushtabs is another feature believed to enhance child resistance by minimizing inadvertent depressions.

SUMMARY OF THE INVENTION

A primary advantage of the present invention is a pushtab located outwardly from both the locking surface and the cantilever connection of the beam of which the pushtab is a part. Such location maximizes pushtab stroke and minimizes pressing force, while maintaining the pushtab flush with or recessed inside an outermost surface of the closure. Child resistance is thereby maximized while adult friendliness is also improved. Child resistance is optimized by having two pushtabs which must be depressed simultaneously.

In practicing the construction of a child resistant bottle closure of the present invention, resiliently deformable pushtabs are preferably applied to bottles having tall finishes and large closures, such as those which offer volumetric dosages via filling and emptying the closure. In order for the locking surface of each pushtab to be located between the cantilever connection and the pushtab, the cantilever connection is located inside the closure. In order for the pushtab to be radially depressed, the cantilever connection is not only inside the closure, but located well above the locking surface inside the closure.

In one preferred aspect of the present invention, a package suitable for storing and dispensing potentially dangerous material is resistant to opening by children yet readily openable by adults. It comprises a bottle for containing the potentially dangerous material. The bottle has a body and a finish portion, the finish portion having a threaded outer end for mating with a closure and an inner end adjacent the body of the bottle. This embodiment further comprises a resiliently deformable cantilevered beam connected to the finish portion between the threaded outer end and the body of the bottle. The cantilevered beam is positioned outward and downward from the finish portion to form an angle to the finish portion. The cantilevered beam has a length, a substantially vertical locking surface, and a pushtab spaced along the length. The angle to the finish portion is small enough that the pushtab may be depressed substantially radially toward the finish portion.

This aspect preferably includes a closure having an outermost surface, an upper inner surface, and a lower inner surface. The upper inner surface has threads for rotatably securing the closure to the finish portion of the bottle. The closure also has a tooth projecting radially inward from its lower inner surface. This tooth is so shaped and positioned that it will engage the locking surface of the cantilevered beam whenever there is an attempt to unscrew the closure. It thereby prevents removal of the closure until the pushtab is manually depressed to disengage the closure tooth from the locking surface of the beam.

Another element of the present invention is a guard ring supported from the finish portion of the bottle below the outermost surface of the closure when the closure is installed. The guard ring has an outermost surface with a recess therein. The recess provides clearance for the pushtab to be operated. The recess is wide enough for an adult to fit a finger or thumb into it in order to be able to fully depress the pushtab. The guard ring also has a bottom edge, which together with the outermost surface of the guard ring, protects the pushtab from being inadvertently depressed by a child. Internal to the guard ring outermost surface is a stop surface behind the pushtab to be pressed against in order to avoid overstroking the pushtab. Overstroking could cause the cantilevered beam to become overstressed.

In still another aspect of a child resistant bottle closure of the present invention, the locking surface of the pushtab is located between the bottle finish and the pushtab so that depression of the pushtab results in a greater beam deflection and lower deflection force at the pushtab than at the locking surface.

In the present invention a pushtab may be located radially flush with the outermost surface of the closure when the locking surface of the cantilevered beam engages the tooth of the closure. Alternatively, a pushtab may be radially recessed interior to the outermost surface of the closure when the locking surface of the cantilevered beam engages the tooth of the closure.

Ideally, the finish portion of the bottle has two resiliently deformable cantilevered beams extending therefrom at positions 180° opposed, and the closure has two teeth projecting radially inward from its inner surface. The two teeth are preferably so shaped and positioned that they will engage the locking surface of each of the two cantilevered beams. Two pushtabs 180° opposed provide the optimum child resistance.

BRIEF DESCRIPTION OF THE DRAWINGS

While the specification concludes with claims which particularly point out and distinctly claim the present invention, it is believed that the present invention will be better understood from the following description of preferred embodiments, taken in conjunction with the accompanying drawings, in which like reference numerals identify identical elements and wherein:

DETAILED DESCRIPTION OF THE INVENTION

Figure 1:
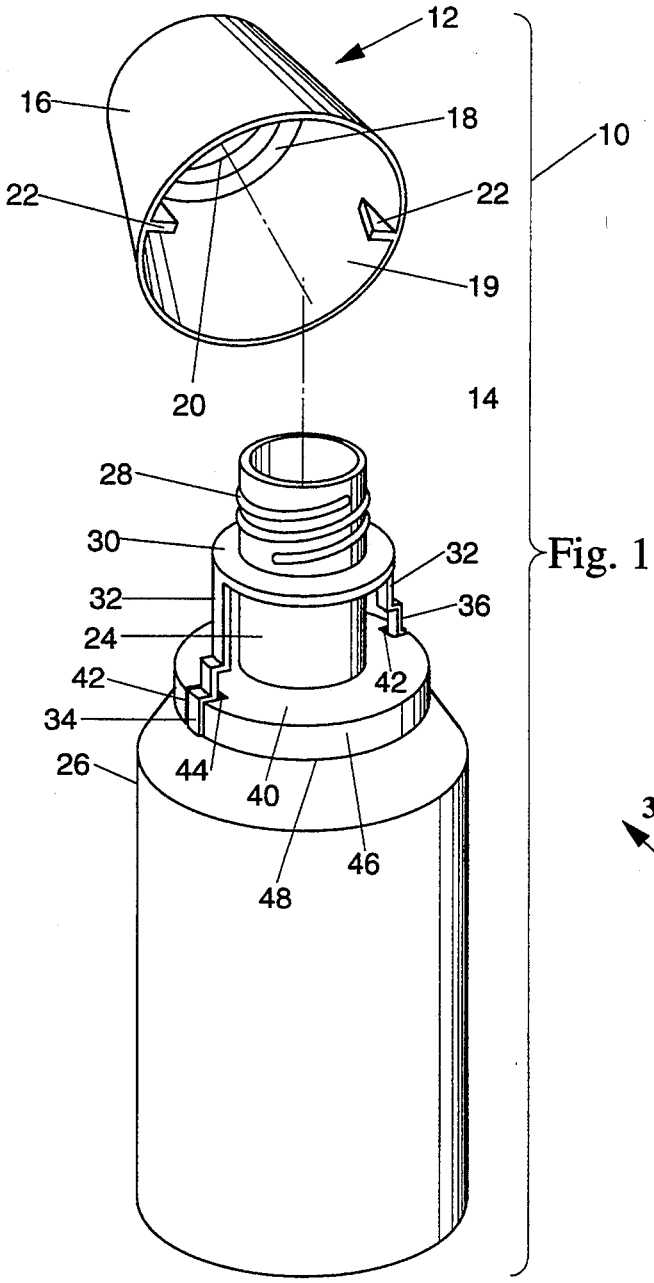
FIG. 1 is an exploded perspective view of a preferred embodiment of the child resistant package of the present invention, disclosing a closure separated from a bottle.
Figure 2:
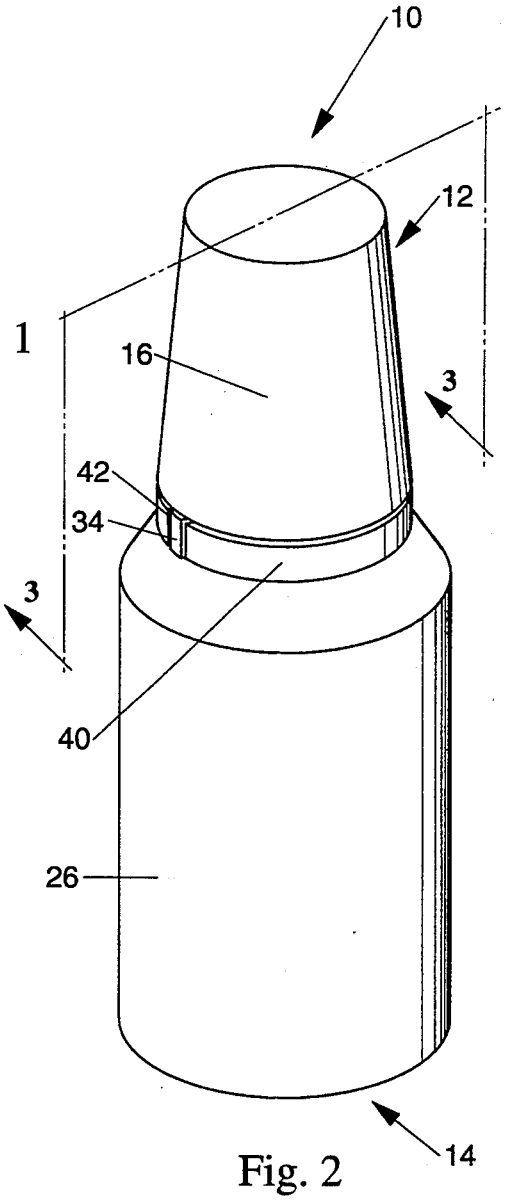
FIG. 2 is a perspective view of the child resistant package of FIG. 1, disclosing the closure connected to the bottle.

Referring now to the drawings, and more particularly to FIGS. 1 and 2, there is shown a preferred embodiment of the present invention, which provides a child resistant package and is generally indicated as 10. Package 10 comprises a closure 12 and a bottle 14. Closure 12 has an outermost surface 16, upper inner surface 18, lower inner surface 19, threads 20, and tooth 22. Preferably there are two teeth 22 which are 180° opposed.

Bottle 14 has a finish portion 24 connected to a body portion 26. Finish portion 24 has a threaded outer end 28 and a support ring 30 located between threaded outer end 28 of finish portion 24 and body portion 26. Extending from support ring 30 is a resiliently deformable cantilevered beam 32. Cantilevered beam 32 has a pushtab 34 at its outer end and a locking surface 36 between pushtab 34 and support ring 30. Preferably there are two resiliently deformable cantilevered beams 32 which are positioned 180° opposed, and which are angled downward and outward from support ring 30. A small angle 38 (shown only in FIG. 3) is formed between a line from pushtab 34 to its cantilevered end and a centerline parallel to finish portion 24.

Also extending from finish portion 24 is a guard ring 40. Guard ring 40 is located between support ring 30 and body portion 26 such that it is positioned just below closure 12 when closure 12 is fully threaded onto finish portion 24. Guard ring 40 has a recess 42 to provide clearance for an adult's thumb or finger to operate pushtab 34. Within recess 42 is a stop surface 44 located behind pushtab 34 to limit the stroke of pushtab 34 when pushtab 34 is depressed. Guard ring 40 also has an outermost surface 46 and a bottom edge 48.

FIG. 1 shows closure 12 removed from bottle 14. FIG. 2 shows closure 12 fully threaded onto finish 24 of bottle 14, with the largest part of outermost surface 16 of closure 12 substantially flush with outermost surface 46 of guard ring 40 and pushtab 34 within recess 42. To open closure 12 one must locate pushtab 34, and preferably two opposing pushtabs 34, and depress the pushtab(s) and twist closure 12 counter-clockwise simultaneously. When the pushtab(s) 34 has (have) a depression force of about 2 pounds and a depression stroke of about 0.09 inches, child resistance to closure removal is believed to be provided. Guard ring 40 provides aesthetic benefits and a its bottom edge 48 provides a lip over which a closure shrinkband may be wrapped in order to provide tamper evidence to the package. Guard ring 40 also protects pushtab(s) 34 from inadvertent depression by a child feeling around the closure while trying to figure out how to open it.

An adult may easily remove closure 12. The adult is instructed by label directions to press pushtab(s) 34 and twist closure 12 simultaneously, and the forces are low compared to most other child resistant closures. Therefore, even older adults with arthritis find the package of the present invention user-friendly.

Figure 3:
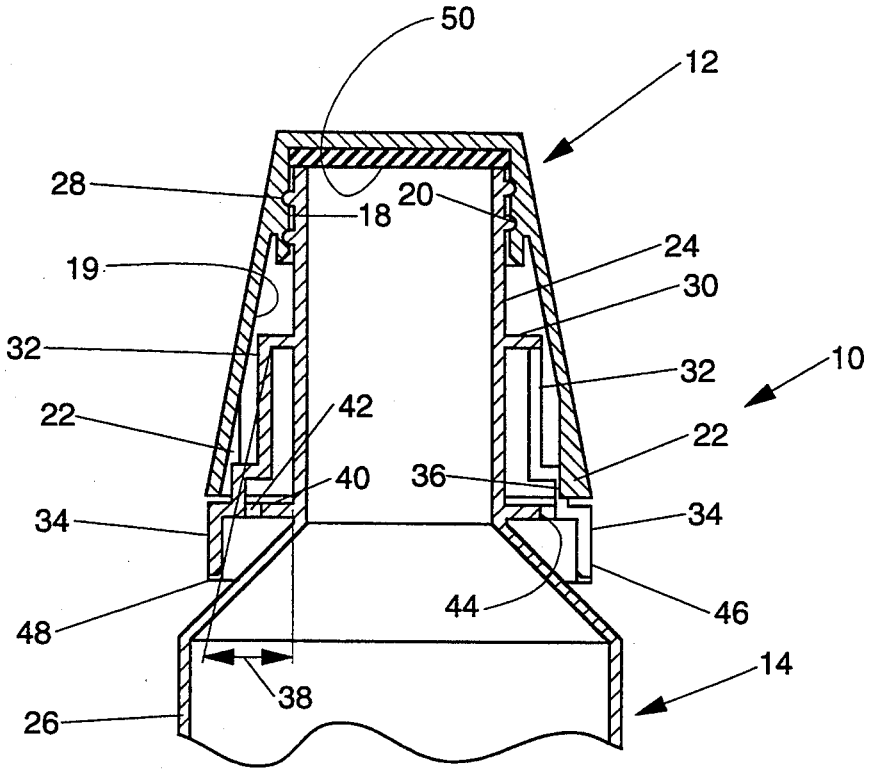
FIG. 3 is a sectioned partial front elevation view, taken along section line 3—3 of FIG. 2, showing two closure teeth engaged with two locking surfaces of two resiliently deformable beams cantilevered from the bottle finish.
Figure 4:
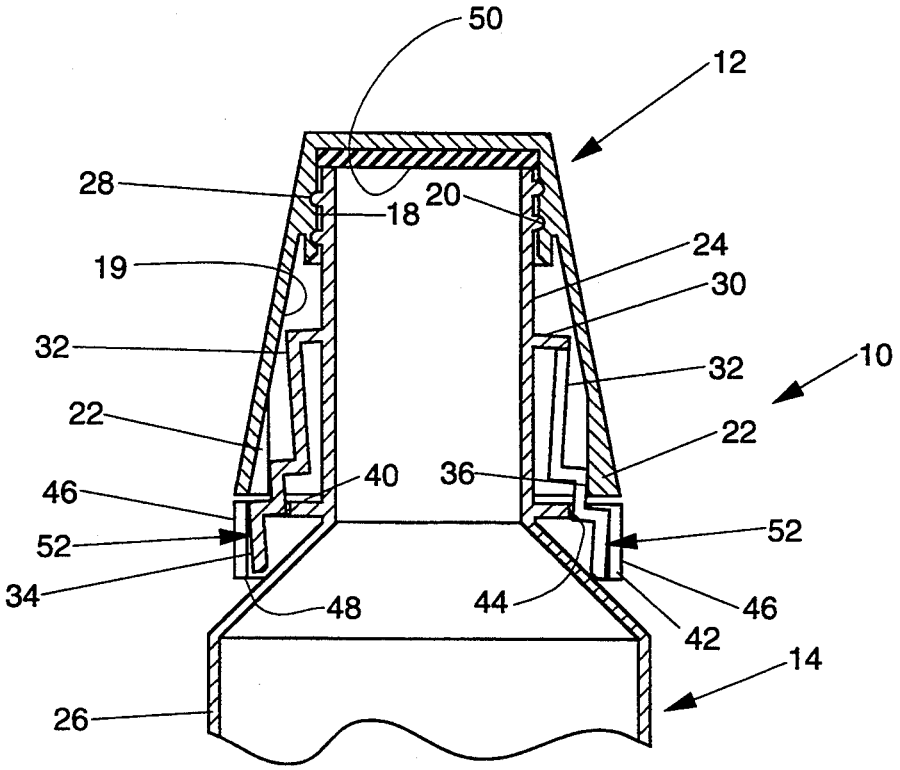
FIG. 4 is the same as FIG. 3, except that the cantilevered beams are shown bent inward from both sides as the pushtabs are depressed to disengage the two closure teeth from the locking surfaces of the cantilevered beam.

FIGS. 3 and 4 are cross-section views which show more clearly how the child resistant closure mechanism functions. FIG. 3 shows the condition of two pushtabs 34, two locking surfaces 36 and two closure teeth 22 when the package is fully closed and locked. FIG. 4 shows the condition after the pushtabs 34 have been depressed to release the teeth 22 from locking surfaces 36, but prior to twisting the closure 16 to unscrew it.

FIG. 3 shows small angle 38, described hereinbefore. Pushtabs 34 move through a portion of angle 38 when they are depressed. Because angle 38 is small, pushtabs 34 move predominantly in a radial direction. Radial motion of pushtabs 34 enables either pushtab to be depressed without causing rotation of the closure. Therefore, if one pushtab is pressed but not the other, the depressed pushtab will spring back to its outermost locking position when it has been released. Without radial pushtab motion, some rotation of the closure is typical. Then one pushtab may become stuck in a depressed condition before the other pushtab has been pressed. This condition enables sequential pressing of the pushtabs, which is less child resistant than simultaneous pressing.

FIG. 3 also shows a closure-to-finish seal 50, which is an element commonly known in the art for packages where an air-tight seal is desired. Other means for closing bottle finish 24 are also applicable to this package. In FIG. 3 it can also be seen that support ring 30 for cantilevered beams 32 extends almost to lower inner surface 19 of closure 12. Support ring 30 acts as a centering device for the installation of closure 12 to prevent cross-threading.

FIG. 4 includes all the elements of FIG. 3, but in addition has pressing forces 52 shown at pushtabs 34. Cantilevered beams 32 are shown bent under the load of forces 52. Under about a 2 pound load pushtabs 34 are pressed against stop surfaces 44 of recesses 42 in guard ring 40. In this condition, teeth 22 of closure 12 are clear of locking surfaces 36 on cantilevered beams 32, so that closure 12 is free to be unscrewed.

FIG. 4 also shows outermost surface 46 of guard ring 40 flush with the largest part of outermost surface 16 of closure 12. Closure 12 clears guard ring 40 by only a small gap when it is fully installed. Guard ring 40 has recesses 42 for pushtabs 34. Guard ring 40 is not necessarily continuous. It can be molded as part of the bottle or be a separate piece, depending on its shape.

Figure 5:
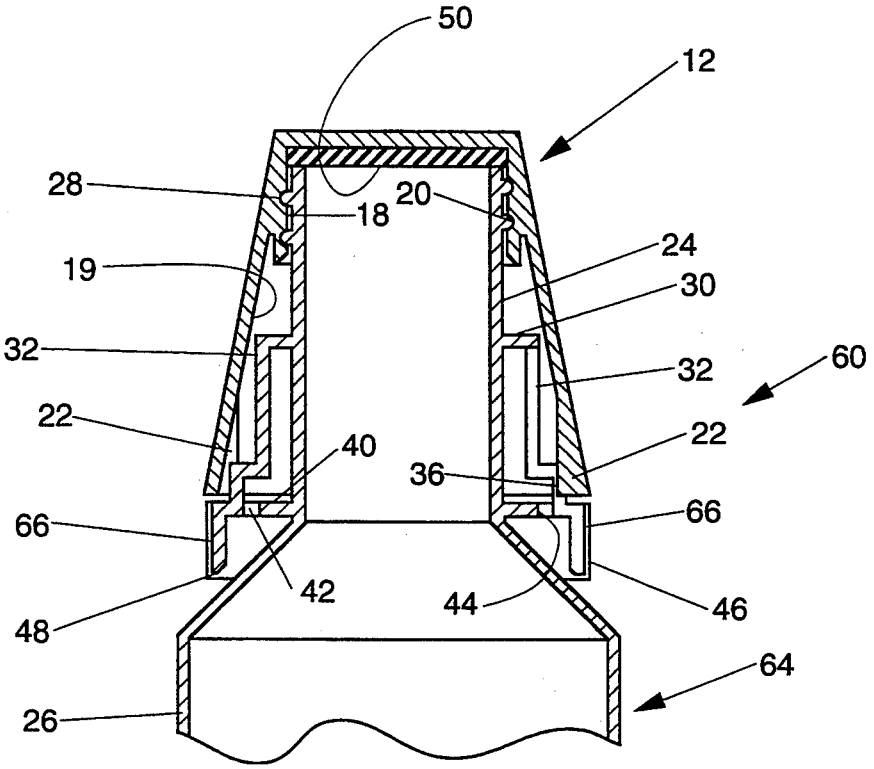
FIG. 5 is a sectioned partial front elevation view, similar to FIG. 3, disclosing an alternative embodiment of the present invention wherein the pushtabs are radially recessed interior to the outermost surface of the closure and a guard ring when the locking surface of the cantilevered beam engages the tooth of the closure.

FIG. 5 discloses an alternative embodiment 60 of the present invention. Embodiment 60 has a bottle 64 with two pushtabs 66 cantilevered from bottle 64 which are initially radially recessed interior to the outermost surfaces of closure 12 and guard ring 40 when locking surface 36 of cantilevered beam 32 engages tooth 22 of closure 12.

In one preferred embodiment of the present invention, closure 12 is a 35 mm standard thread cap which is made of polypropylene in either a homo or co-polymer form. The material preferably has a modulus of elasticity of 200,000 psi or higher so that the teeth 22 are not easily distorted and prematurely released by a child attempting to remove the closure without pressing the pushtabs. Closure rigidity is therefore important. Closure 12 is made by a commonly known injection molding process, wherein the mold has an unscrewing core far forming female threads on the inside of the closure. The closure is preferably tapered from an outer diameter of about 1.56 inches at the top to about 2 inches at the bottom in order to provide space for support ring 30 and the downward extending cantilevered beams 32. Closure height is about 1.93 inches. The closure preferably has an internal skirt to fit the threads of the straight bottle finish. The double skirt design allows for a greater overall closure taper than might otherwise be permitted.

Bottle 14 has a standard 35 mm male threaded finish portion which is approximately 2.25 inches tall from bottom of pushtabs 34 to its open top end. The width of cantilevered beam 32 is approximately 0.31 inches. The overall length of the beam is about 1.1 inches. The length from support ring 30 to the center of locking surface 36 is about 0.65 inches, and the distance from support ring 30 to the center of pushtab 34 is about 0.9 inches. On average the beam is about 0.09 inches thick. Leverage provided by having the pushtab located outward from the locking surface is about 1.38:1. Therefore, a 2.75 pound force at the locking surface to clear the 0.06 tooth engagement requires only a 2 pound pressing force at the pushtab. Angle 38 is approximately 10°. For this geometry, the preferred material of construction for bottle 14 is a thermoplastic polyester (PET) having a modulus of elasticity of about 375,000 psi. the preferred method of manufacture is to injection mold the finish down through the guard ring along with a cylindrical preform therebelow. The preform is then transferred to a blow mold and blown outward to the shape of an external bottle mold. This process is commonly known as "injection blow molding". The injection molded portion is preferably made in a split cavity mold. However, the guard ring configuration shown may require a solid body, split thread cavity mold arrangement.

In order that a removed closure may be reinstalled without having to manually depress both pushtabs, the most preferred embodiment of the present invention includes ramped surfaces on both teeth 22 of closure 12. While such ramps are not shown in FIG. 1, they comprise a gradual blending of lower inner surface 19 with the tips of teeth 22 from the sides opposite teeth 22 which engage locking surfaces 36. Therefore, when closure 12 is threaded clockwise onto bottle 14, the ramps act to cam the cantilevered beams 32 inward while the teeth rotationally pass the locking surfaces. Once the teeth have passed the locking surfaces, the cantilevered beams snap back to their pre-deflected positions, thereby locking the closure in place.

While particular embodiments of the present invention have been illustrated and described, it will be obvious to those skilled in the art that various changes and modifications may be made without departing from the spirit and scope of the invention, and it is intended to cover in the appended claims all such modifications that are within the scope of the invention.

What is claimed is:

1. A package suitable for storing and dispensing potentially dangerous material, said package being resistant to opening by children yet readily openable by adults, said package comprising:

a) a bottle for containing said potentially dangerous material, said bottle having a body and a finish portion, said finish portion having a threaded outer end and a support ring located between said threaded outer end and said body of said bottle;

b) a resiliently deformable cantilevered beam connected to said support ring, said cantilevered beam being positioned outward and downward from said support ring to form an angle to said finish portion, said cantilevered beam having a length, a substantially vertical locking surface, and a pushtab spaced along said length, said angle to said finish portion being small enough that said pushtab may be depressed substantially radially toward said finish portion; and c) a closure having an outermost surface, an upper inner surface, and a lower inner surface, said upper inner surface having threads for rotatably securing said closure to said threaded outer end of said finish portion, said closure also having a tooth projecting radially inward from said lower inner surface, said tooth being so shaped and positioned that it engages said locking surface of said cantilevered beam whenever there is an attempt to unscrew said closure, thereby preventing removal of said closure until said pushtab is manually depressed to disengage said tooth of said closure from said locking surface of said cantilevered beam.

2. The package of claim 1 wherein said finish portion has two resiliently deformable cantilevered beams extending therefrom at positions 180° opposed, and said closure has two teeth projecting radially inward from said lower inner surface, said two teeth being so shaped and positioned that they will engage said locking surface of each of said two cantilevered beams.

3. The package of claim 1 wherein said pushtab is located radially flush with said outermost surface of said closure when said locking surface of said cantilevered beam engages said tooth of said closure.

4. The package of claim 1 wherein said pushtab is radially recessed interior to said outermost surface of said closure when said locking surface of said cantilevered beam engages said tooth of said closure.

5. The package of claim 1 further comprising:

d) a guard ring supported from said finish portion of said bottle and located below said outermost surface of said closure when said closure is installed, said guard ring having an outermost surface, said outermost surface having a recess therein, said recess providing clearance for said pushtab such that said pushtab may be depressed by an adult's finger or thumb, said guard ring also having a bottom edge, which together with said outermost surface of said guard ring protects said pushtab from being inadvertently depressed by a child.

6. The package of claim 5 wherein said pushtab is located radially flush with said outermost surface of said guard ring when said locking surface of said cantilevered beam engages said tooth of said closure.

7. The package of claim 5 wherein said pushtab is radially recessed interior to said outermost surface of said guard ring when said locking surface of said cantilevered beam engages said tooth of said closure.

8. The package of claim 5 wherein said guard ring has a stop surface internal to said outermost surface behind said pushtab so that said pushtab may be pressed against said stop surface in order to avoid overstroking said pushtab.

9. A package suitable for storing and dispensing potentially dangerous material, said package being resistant to opening by children yet readily openable by adults, said package comprising:

a) a bottle for containing said potentially dangerous material, said bottle having a body and a finish portion, said finish portion having a threaded outer end and a support ring located between said threaded outer end and said body of said bottle;

b) a resiliently deformable cantilevered beam connected to said support ring, said cantilevered beam being positioned outward and downward from said support ring to form an angle to said finish portion, said cantilevered beam having a length, a substantially vertical locking surface, and a pushtab spaced along said length, said angle to said finish portion being small enough that said pushtab may be depressed substantially radially against said finish portion, said locking surface being located between said support ring and said pushtab so that depression of said pushtab results in a greater beam deflection and lower deflection force at said pushtab than at said locking surface; and c) a closure having an outermost surface, an upper inner surface, and a lower inner surface, said upper inner surface having threads for rotatably securing said closure to said threaded outer end of said finish portion, said closure also having a tooth projecting radially inward from said lower inner surface, said tooth being so shaped and positioned that it engages said locking surface of said cantilevered beam whenever there is an attempt to unscrew said closure, thereby preventing removal of said closure until said pushtab is manually depressed to disengage said tooth of said closure from said locking surface of said cantilevered beam.

10. The package of claim 9 wherein said finish portion has two resiliently deformable cantilevered beams extending therefrom at positions 180° opposed, and said closure has two teeth projecting radially inward from said lower inner surface, said two teeth being so shaped and positioned that they will engage said locking surface of each of said two cantilevered beams.

11. The package of claim 9 wherein said pushtab is located radially flush with said outermost surface of said closure when said locking surface of said cantilevered beam engages said tooth of said closure.

12. The package of claim 9 wherein said pushtab is radially recessed interior to said outermost surface of said closure when said locking surface of said cantilevered beam engages said tooth of said closure.

13. The package of claim 9 further comprising:

d) a guard ring supported from said finish portion of said bottle and located below said outermost surface of said closure when said closure is installed, said guard ring having an outermost surface, said outermost surface having a recess therein, said recess providing clearance for said pushtab such that said pushtab may be depressed by an adult's finger or thumb, said guard ring also having a bottom edge, which together with said outermost surface of said guard ring protects said pushtab from being inadvertently depressed by a child.

14. The package of claim 13 wherein said pushtab is located radially flush with said outermost surface of said guard ring when said locking surface of said cantilevered beam engages said tooth of said closure.

15. The package of claim 13 wherein said pushtab is radially recessed interior to said outermost surface of said guard ring when said locking surface of said cantilevered beam engages said tooth of said closure.

16. The package of claim 13 wherein said guard ring has a stop surface internal to said outermost surface behind said pushtab so that said pushtab may be pressed against said stop surface in order to avoid overstroking said pushtab.

17. A package suitable for storing and dispensing potentially dangerous material, said package being resistant to opening by children yet readily openable by adults, said package comprising:

a) a bottle for containing said potentially dangerous material, said bottle having a body and a finish portion, said finish portion having a threaded outer end and a support ring located between said threaded outer end and said body of said bottle;

b) a resiliently deformable cantilevered beam connected to said support ring, said cantilevered beam being positioned outward and downward from said support ring to form an angle to said finish portion, said cantilevered beam having a length, a substantially vertical locking surface, and a pushtab spaced along said length, said angle to said finish portion being small enough that said pushtab may be depressed substantially radially against said finish portion, said locking surface being located between said support ring and said pushtab so that depression of said pushtab results in a leverage of about 1.38 to 1, said leverage providing greater beam deflection and lower deflection force at said pushtab than at said locking surface;

c) a closure having an outermost surface, an upper inner surface, and a lower inner surface, said upper inner surface having threads for rotatably securing said closure to said threaded outer end of said finish portion, said closure also having a tooth projecting radially inward from said lower inner surface, said tooth being so shaped and positioned that it engages said locking surface of said cantilevered beam whenever there is an attempt to unscrew said closure, thereby preventing removal of said closure until said pushtab is manually depressed by a force of about 2 pounds to disengage said tooth of said closure from said locking surface of said cantilevered beam; and d) a guard ring supported from said finish portion of said bottle and located below said outermost surface of said closure when said closure is installed, said guard ring having an outermost surface, said outermost surface having a recess therein, said recess providing clearance for said pushtab such that said pushtab may be depressed into said recess, said recess having a substantially vertical edge at each side of said pushtab to help prevent inadvertent depression of said pushtab.

18. The package of claim 17 wherein said cantilevered beam is about 1.1 inches long and said angle is approximately 10°.

* * * * *